US010869521B2

(12) United States Patent
Kim et al.

(10) Patent No.: US 10,869,521 B2
(45) Date of Patent: Dec. 22, 2020

(54) HELMET

(71) Applicant: KIDO SPORTS CO., LTD., Seoul (KR)

(72) Inventors: Young Il Kim, Gyeonggi-do (KR); Young Chong Lee, Seoul (KR)

(73) Assignee: KIDO SPORTS CO., LTD., Seoul (KR)

( * ) Notice: Subject to any disclaimer, the term of this patent is extended or adjusted under 35 U.S.C. 154(b) by 196 days.

(21) Appl. No.: 15/293,404

(22) Filed: Oct. 14, 2016

(65) Prior Publication Data

US 2018/0103710 A1 Apr. 19, 2018

(51) Int. Cl.
*A42B 3/22* (2006.01)
*A42B 3/32* (2006.01)

(52) U.S. Cl.
CPC ..... *A42B 3/227* (2013.01); *A42B 3/326* (2013.01)

(58) Field of Classification Search
CPC .. A42B 3/04; A42B 3/20; A42B 3/205; A42B 3/22; A42B 3/221; A42B 3/223; A42B 3/222; A42B 3/227
See application file for complete search history.

(56) References Cited

U.S. PATENT DOCUMENTS 2,597,798 A * 5/1952 Houplain ..... F16B 1/04 192/223.2
2,866,978 A * 1/1959 Stuart ..... A42B 3/32 2/423
2,986,739 A * 6/1961 Rozzi, Sr. ..... A42B 3/20 2/9
3,067,427 A * 12/1962 McClintock, Sr. ..... A42B 3/20 2/9
3,135,962 A * 6/1964 Dunning ..... A42B 3/08 128/857
3,139,624 A * 7/1964 Humphrey ..... A42B 3/20 2/9
3,170,164 A * 2/1965 Holder ..... A42B 3/20 2/9
4,070,712 A * 1/1978 Marwitz ..... A42B 3/221 2/10
4,170,792 A * 10/1979 Higgs ..... F16C 11/10 2/10
4,312,078 A * 1/1982 Pollitt ..... A42B 3/222 16/348

(Continued)

FOREIGN PATENT DOCUMENTS

KR 100649944 B1 11/2006

*Primary Examiner* — Sally Haden
(74) *Attorney, Agent, or Firm* — Panitch Schwarze Belisario & Nadel LLP

(57) ABSTRACT

A helmet according to the present invention includes: a head frame being open toward the user's face, designed to cover the user's head, and having a rotation part at both sides; a face frame coupled to be turned up and down about the rotation parts and selectively closing the opening of the head frame; and a sun visor disposed at an upper portion of the face frame and coupled to be turned up and down about the rotation parts, in which the sun visor is turned up with the face frame when the face frame is turned up to open the opening of the head frame, and is fixed regardless of rotation of the face frame when a predetermined rotational limit is reached.

1 Claim, 10 Drawing Sheets

(56) References Cited

U.S. PATENT DOCUMENTS 4,462,119 A * 7/1984 Rudd ..... A42B 3/221 2/424
4,718,127 A * 1/1988 Rittmann ..... A42B 3/223 16/326
4,748,696 A * 6/1988 Fohl ..... A42B 3/223 2/10
4,885,806 A * 12/1989 Heller ..... A42B 3/20 2/423
5,012,528 A * 5/1991 Pernicka ..... A42B 3/225 2/10
5,093,936 A * 3/1992 Copeland ..... A42B 3/14 2/410
5,129,108 A * 7/1992 Copeland ..... A42B 3/14 2/424
5,177,816 A * 1/1993 Schmidt ..... A42B 3/221 2/424
5,230,101 A * 7/1993 Hedges ..... A42B 3/226 2/10
5,412,814 A * 5/1995 Pernicka ..... A42B 3/20 2/424
5,652,954 A * 8/1997 Paiement ..... A61F 9/027 2/10
5,893,174 A * 4/1999 Primeau ..... A42B 3/20 2/10
6,047,409 A * 4/2000 Simpson ..... A42B 3/223 2/424
6,298,498 B1 * 10/2001 Burns ..... A42B 3/10 2/424
6,842,913 B1 * 1/2005 Song ..... A42B 3/222 2/424
7,225,471 B2 * 6/2007 Sutter ..... A42B 3/228 2/424
8,082,600 B2 * 12/2011 Morin ..... A42B 3/326 2/15
8,291,513 B2 * 10/2012 Prinkey ..... A42B 3/22 2/15
9,210,961 B2 * 12/2015 Torres ..... A42B 3/063
9,814,622 B2 * 11/2017 Sommers ..... A42B 3/225
9,848,665 B2 * 12/2017 Gendron ..... A42B 3/04
2004/0019956 A1 * 2/2004 Arai ..... A42B 3/222 2/410
2006/0064799 A1 * 3/2006 Dion ..... A42B 3/222 2/424
2006/0101561 A1 * 5/2006 Kuo ..... A42B 3/222 2/424
2007/0124851 A1 * 6/2007 Pyo ..... A42B 3/222 2/424
2008/0196148 A1 * 8/2008 Morin ..... A42B 3/222 2/421
2009/0100576 A1 * 4/2009 Kim ..... A42B 3/222 2/424
2009/0288242 A1 * 11/2009 Kato ..... A42B 3/223 2/425
2012/0284906 A1 * 11/2012 Kuo ..... A42B 3/223 2/424
2013/0191976 A1 * 8/2013 Pizzi ..... A42B 3/22 2/424
2016/0015114 A1 * 1/2016 Berthier ..... A42B 3/222 2/424
2017/0188646 A1 * 7/2017 Liang ..... A42B 3/042
2018/0103710 A1 * 4/2018 Kim ..... A42B 3/227

* cited by examiner

[Fig. 1]
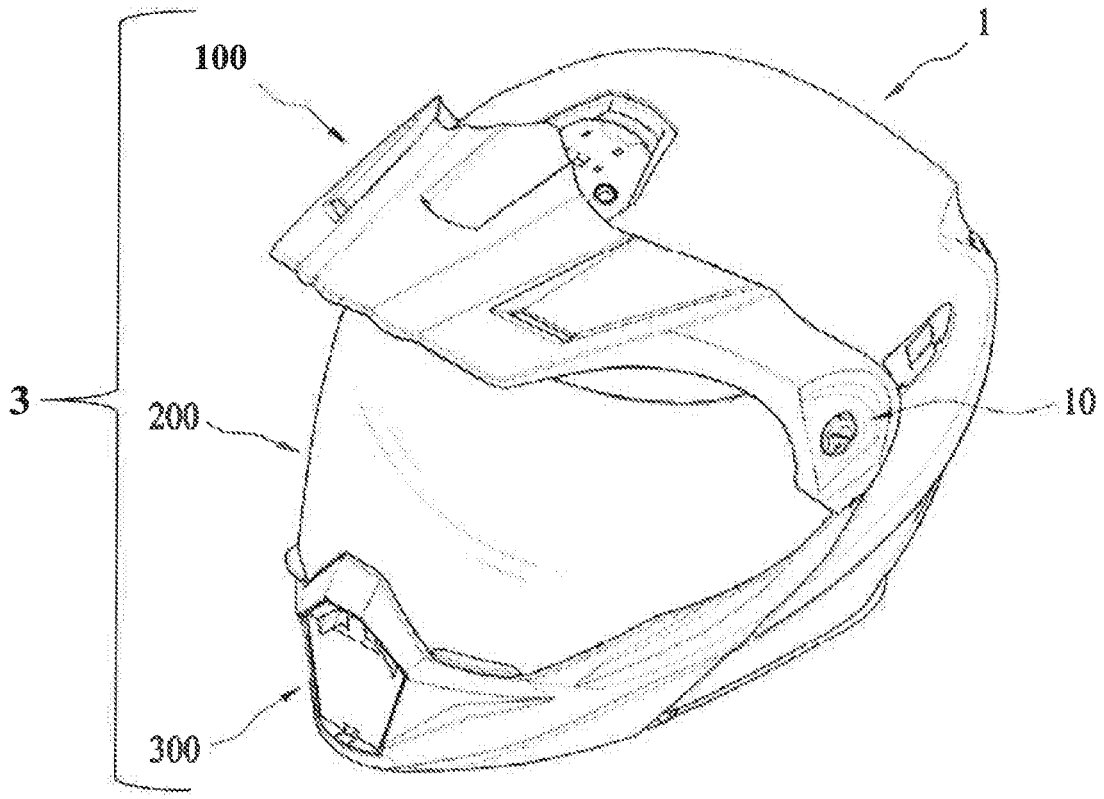

[Fig. 2]
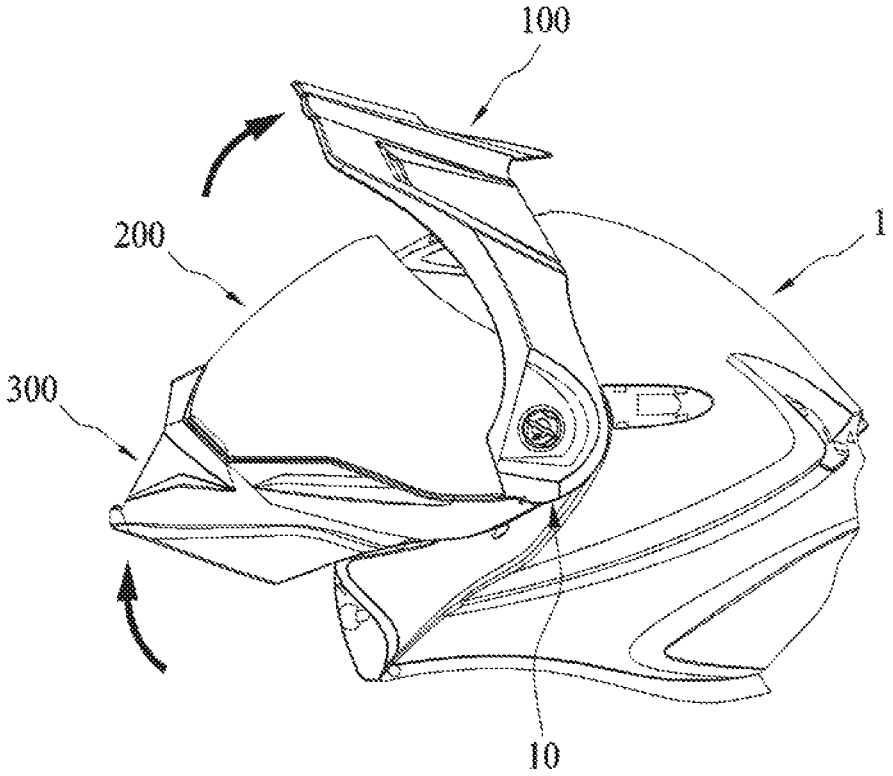

[Fig. 3]
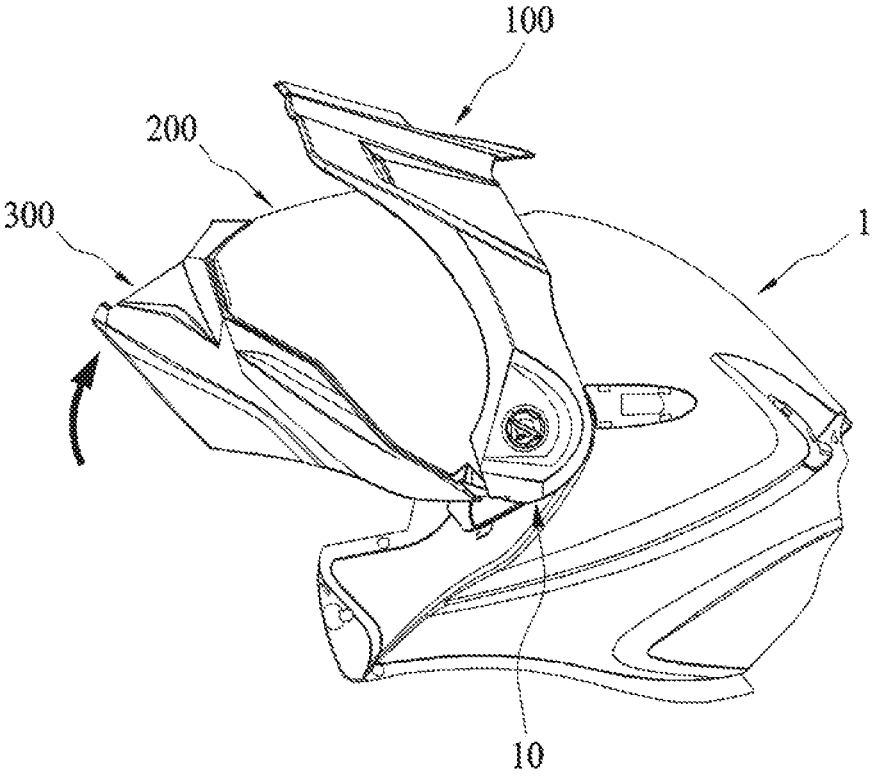

[Fig. 4]
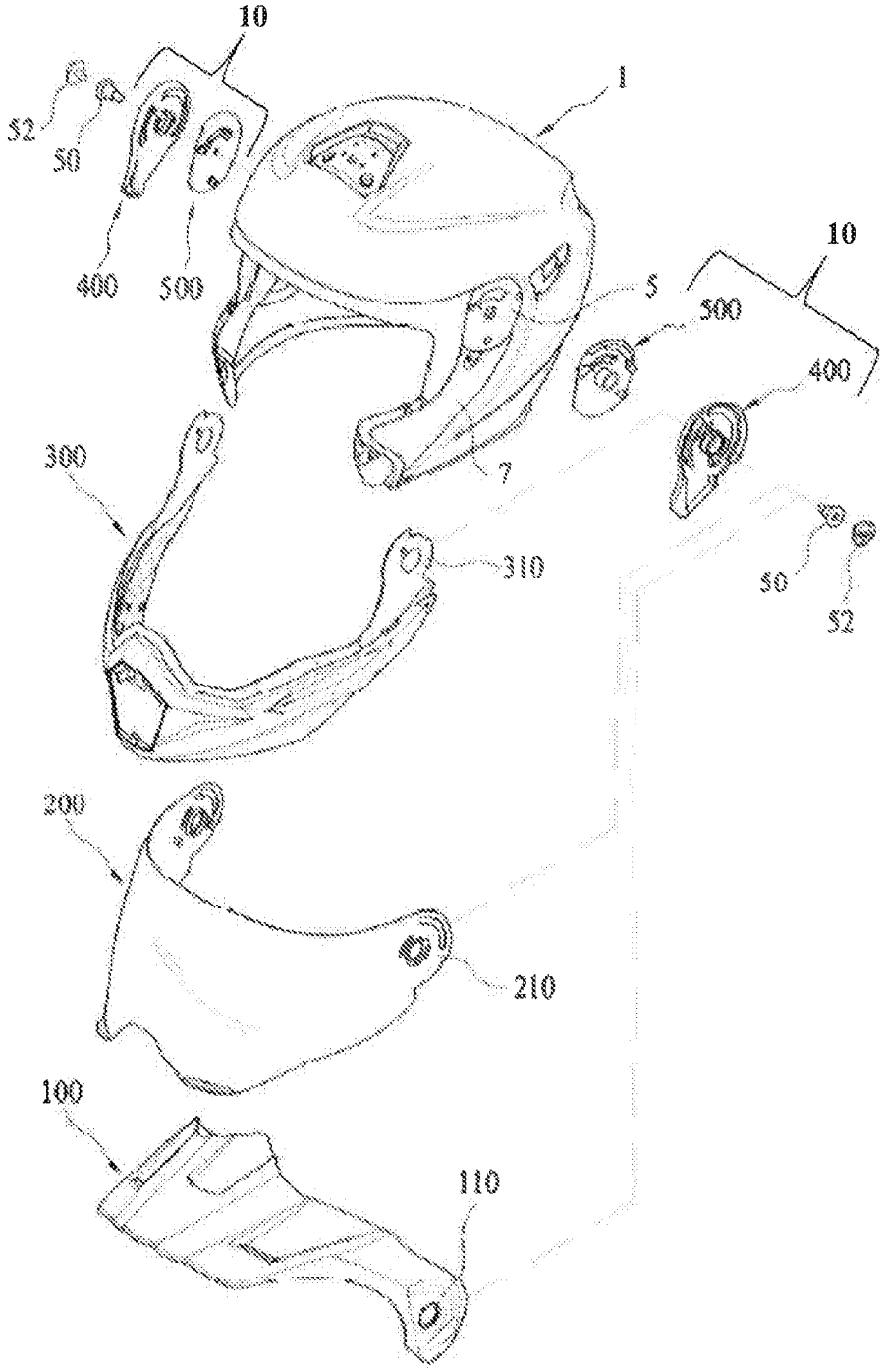

[Fig. 5]
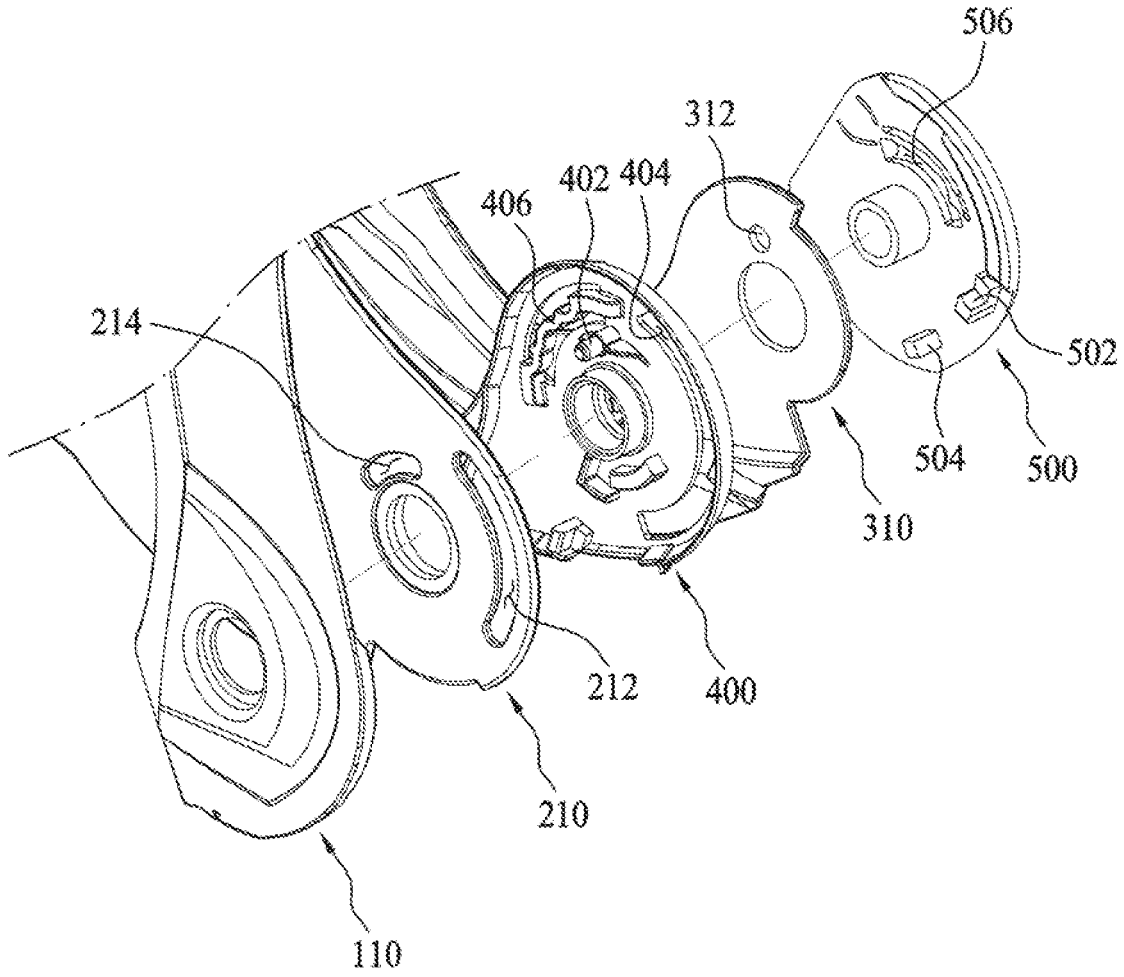

[Fig. 6]
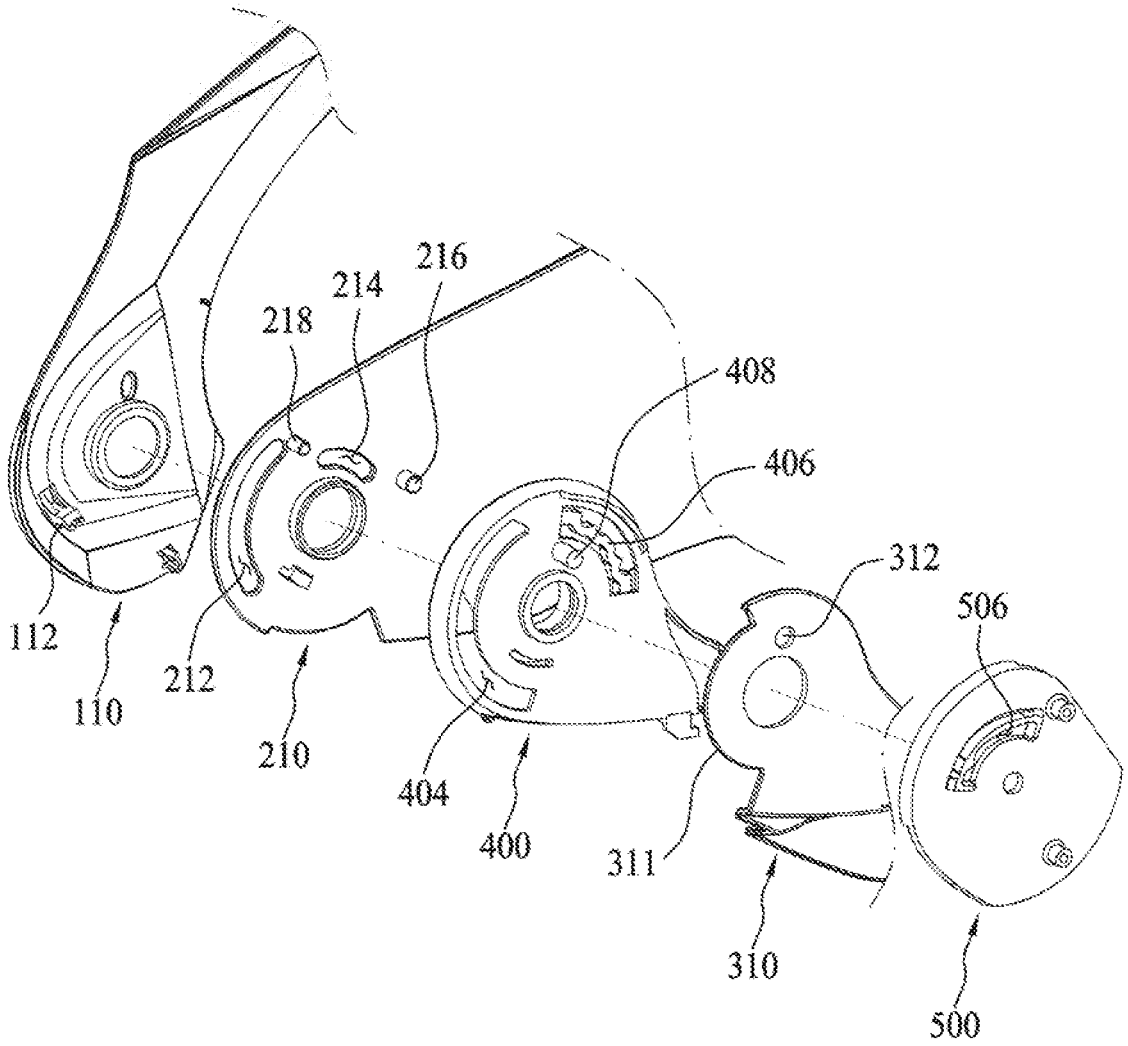

[Fig. 7]
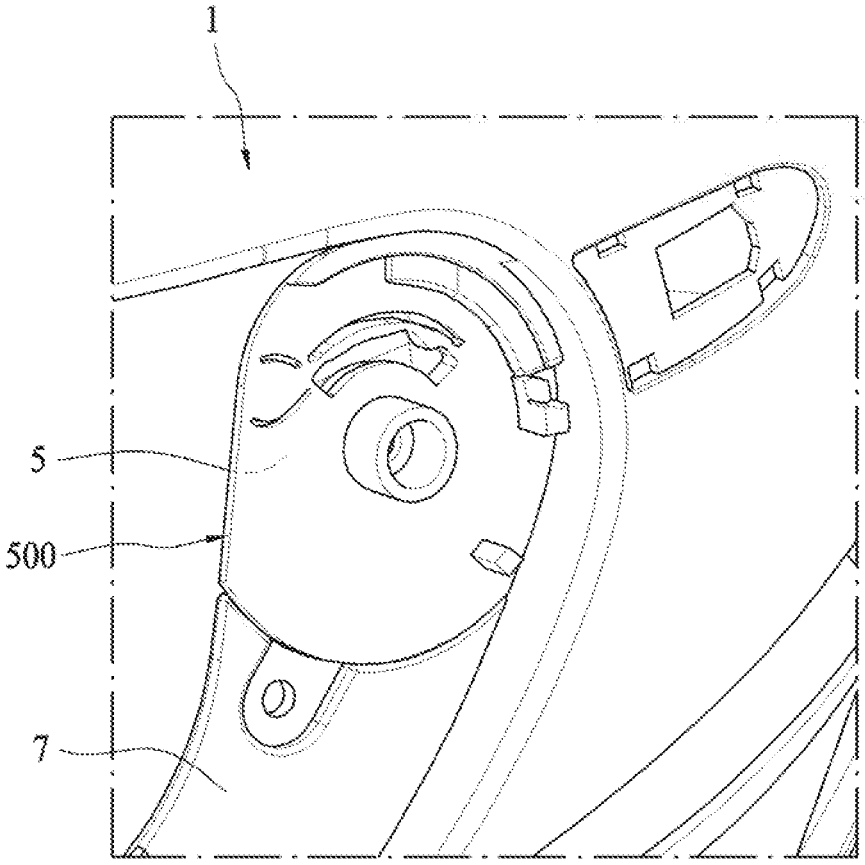

[Fig. 8]
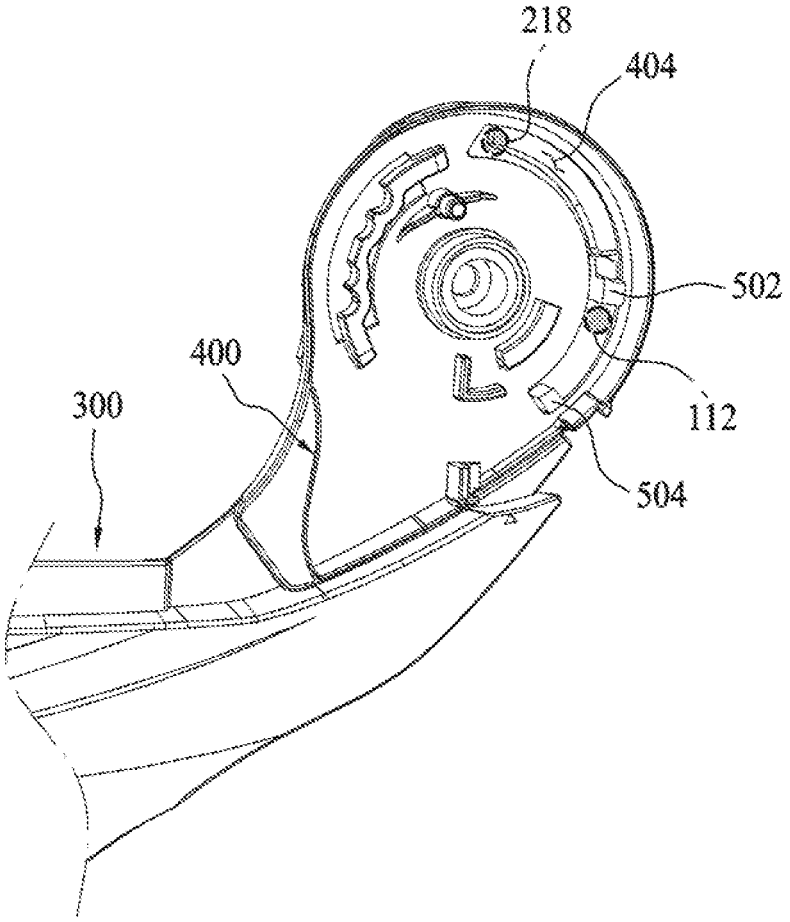

[Fig. 9]
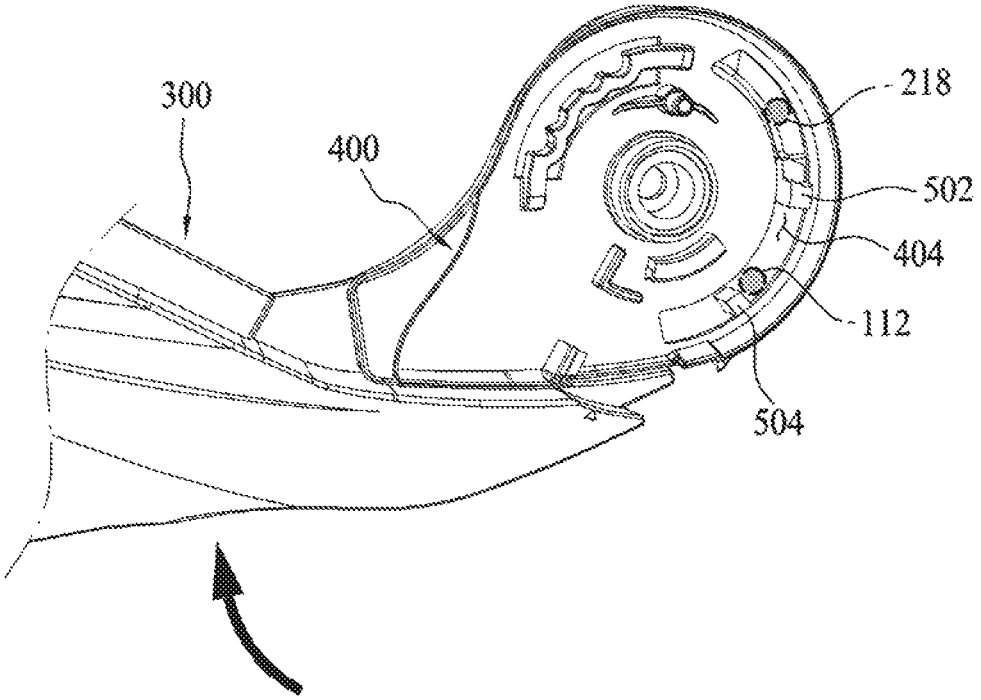

[Fig. 10]
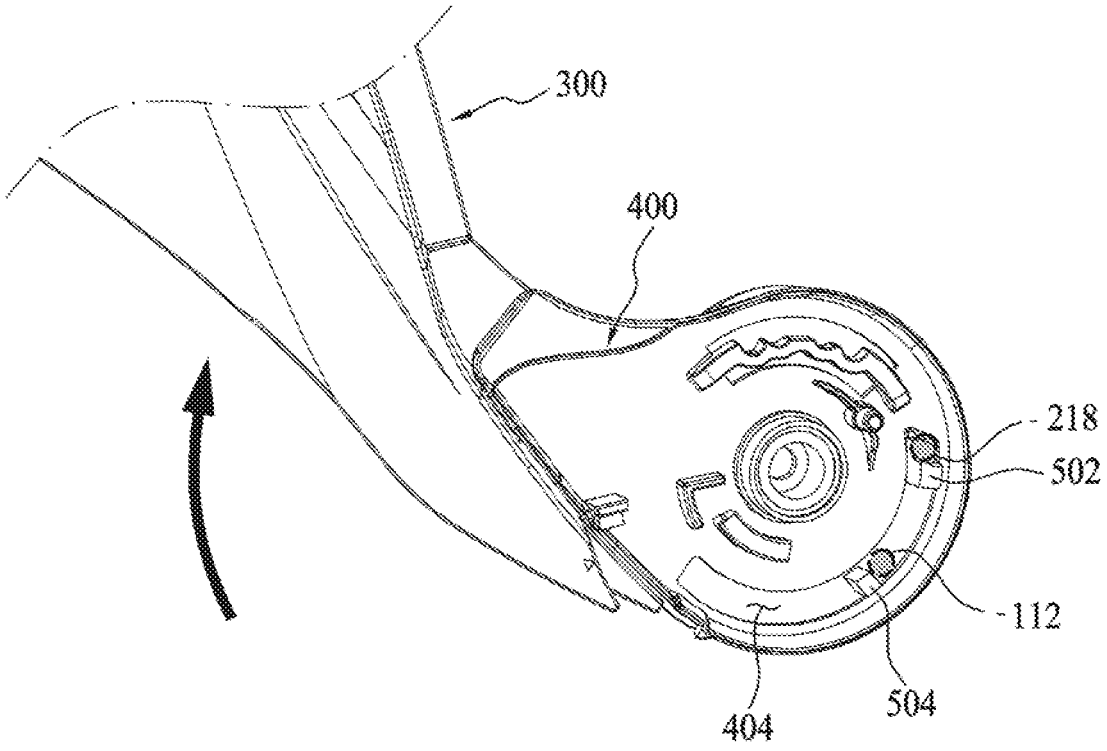

HELMET

TECHNICAL FIELD

The present invention relates to a helmet for protecting the head of a user and, more particularly, to a variable helmet of which the rotational angle of a sun visor when a face frame is opened.

BACKGROUND ART

In general, a helmet is a form of gear for protecting the head of a rider on a motorcycle etc. and it is prescribed to wear a helmet for safety when riding.

Helmets protect the wearer's head by having strength high enough to resist without breaking a shock applied from outside and keep a wearer safe by absorbing and attenuating the shock.

Helmets can be classified into a half face type, an open face type, and a full face type, depending on the shapes.

A half face helmet, which is designed to protect only the upper part of the user's head, is convenient to carry due to the small volume and is simple to wear, so many users prefer half face helmets.

An open face helmet, which is designed to cover the upper part, lower part, sides, and rear part of the user's head, is characterized by having a wide protection range as compared with the half face helmet.

A full face helmet, which is designed to cover the entire head, including the face, of a user, has the widest protection range, but is somewhat inconvenient to wear, as compared with the half face helmet and the open face helmet.

Further, full face helmets may be equipped with a sun visor for blocking sunlight and preventing rainwater and dirt from dropping. However, when a user turns up a chin guard and a glass shield to take a full face helmet off the head, a sun visor is also turned in many cases.

In this case, when the sun visor is excessively turned, the sun visor protrudes from the upper portion of the helmet, so it may be broken. Further, full face helmets occupy too large spaces, so it is difficult to efficiently use a space for keeping a helmet.

Furthermore, when a user temporarily turns up the chin guard and the glass shield at the front with a helmet on, the sun visor cannot perform the essential purposes such as blocking sunlight and preventing rainwater and dirt from dropping.

Therefore, there is a need for a method of solving these problems.

Documents of Related Art (Patent Document 1) Korean Patent No. 10-0649944

DISCLOSURE OF INVENTION

Technical Problem

The present invention has been made in an effort to solve the problems in the related art and an object of the present invention is to minimize the possibility of breakage, improve spatial usability, and allows for the essential purpose of a sun visor by limiting the rotational angle of the sun visor when the chin guard and the glass shield at the front of a helmet are opened.

It should be noted that objects of the present invention are not limited to the above-mentioned object and other objects of the present invention will be apparent to those skilled in the art from the following descriptions.

Solution to Problem

In order to achieve the objects of the present invention, a helmet according to the present invention includes: a head frame being open toward the user's face, designed to cover the user's head, and having a rotation part at both sides; a face frame coupled to be turned up and down about the rotation parts and selectively closing the opening of the head frame; and a sun visor disposed at an upper portion of the face frame and coupled to be turned up and down about the rotation parts, in which the sun visor is turned up with the face frame when the face frame is turned up to open the opening of the head frame, and is fixed regardless of rotation of the face frame when a predetermined rotational limit is reached.

The face frame may include: a chin guard designed to cover a chin; and a glass shield disposed over the chin guard to ensure a visual filed for a user.

The chin guard may have third rotary coupling portions coupled to the rotation parts, the glass shield may have second rotary coupling portions coupled to the rotation parts outside the third rotary coupling portions, and the sun visor may have first rotary coupling portions coupled to the rotation parts outside the second rotary coupling portions.

The helmet may further include: a first rotation-assisting member disposed between the second rotary coupling portion and the third rotary coupling portion; and a second rotation-assisting member disposed between the third rotary coupling portion and the head frame.

A first sun visor stopper protruding inward may be formed on the first rotary coupling portion and a second sun visor stopper that is locked to the first sun visor stopper when the sun visor reaches the rotational limit may be formed on the second rotation-assisting member.

A first hole that is a slot in which the first sun visor stopper and the second sun visor stopper are inserted may be formed through the second rotary coupling portion, and a second hole that is a slot in which the first sun visor stopper and the second sun visor stopper are inserted may be formed through the first rotation-assisting member.

The second hole may be longer than the first hole, a first glass shield stopper inserted in the second hole may be formed on the second rotary coupling portion, and a second glass shield stopper that is locked to the first glass shield stopper to limit a rotational range of the glass shield may be formed on the second rotation-assisting member.

Advantageous Effects

The helmet of the present invention has the following effects to solve the problems described above.

First, since the rotational angle of the sun visor is limited when the face frame at the front of the helmet is opened, it is possible to minimize damage and breakage of the sun visor.

Second, since the occupied space with the face frame closed is minimized, spatial usability can be improved.

Third, it is possible to achieve the essential functions of a sun visor such as blocking sunlight and preventing rainwater and dirt from dropping even though a user temporarily opens the face frame.

The effects of the present invention are not limited to those described above and other effects not stated herein may be made apparent to those skilled in the art from claims.

As used in the description of the invention and the appended claims, the singular forms "a", "an" and "the" are intended to include the plural forms as well, unless the context clearly indicates otherwise. The words "and/or" as used herein refers to and encompasses any and all possible combinations of one or more of the associated listed items. The words "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The words "right," "left," "lower" and "upper" designate directions in the drawings to which reference is made. The words "inwardly" and "outwardly" refer to directions toward and away from, respectively, the geometric center of the helmet, and designated parts thereof. The terminology includes the words noted above, derivatives thereof and words of similar import.

Although the words first, second, etc., are used herein to describe various elements, these elements should not be limited by these words. These words are only used to distinguish one element from another. For example, a first rotational-assisting member could be termed a second rotational-assisting member, and, similarly, a second rotational-assisting member could be termed a first rotational-assisting member, without departing from the scope of the present invention.

BRIEF DESCRIPTION OF THE DRAWINGS

FIG. 1 is a view showing a helmet according to an embodiment of the present invention.

FIGS. 2 and 3 are views showing a process of opening of a face frame of the helmet according to an embodiment of the present invention.

FIG. 4 is an exploded view of the helmet according to an embodiment of the present invention.

FIGS. 5 and 6 are views showing in detail the structure of a rotation part in the helmet according to an embodiment of the present invention.

FIG. 7 is a view showing a second rotation-assisting member mounted in a seat of a head frame in the helmet according to an embodiment of the present invention.

FIGS. 8 to 10 are views showing operation of the rotation part when the face frame is opened in the helmet according to an embodiment of the present invention.

DETAILED DESCRIPTION OF THE INVENTION

Embodiments of the present invention for achieving the objects of the in detail will be described hereinafter with reference to the accompanying drawings. In the description of the embodiments, like components are given like names and reference numerals and they are not additionally described.

FIG. 1 is a view showing a helmet according to an embodiment of the present invention.

As shown in FIG. 1, a helmet according to an embodiment of the present invention includes a head frame 1, a face frame 3 including a glass shield 200 and a chin guard 300, and a sun visor 100.

The head frame 1 is designed to cover a head and is open at a portion corresponding to the user's face. The face frame is formed in the open area of the head frame 1 to cover the user's face.

The chin guard 300 is designed to cover the user's chin and the glass shield 200 is disposed over the chin guard 300 to secure the visual field of a user.

Further, the sun visor 100 is disposed over the face frame and, prevents sunlight from traveling to the glass shield 200 and prevents inflow of rainwater and dirt.

A rotation part 10 is formed at both sides of the head frame 1, and the face frame and the sun visor 100 are coupled to the rotation parts 10 such that they can turn up and down. Accordingly, the face frame can be turned to selectively cover the opening of the head frame 1 and the sun visor 100 can also be turned about the rotation parts 10 with rotation of the face frame.

However, according to this embodiment, when the opening of the head frame 1 is opened by turn up the face frame, the sun visor 100 is turned up with the face frame in the early stage, as shown in FIG. 2, but when a predetermined rotational limit is reached, the sun visor 100 is fixed regardless of rotation of the face frame, as shown in FIG. 3.

That is, according to the helmet of this embodiment, when the face frame is opened, the sun visor 100 is turned with the face frame to the rotational limit, but the sun visor 100 is fixed and only the face frame can be turned after the rotational limit.

The structure of the rotation parts 10 is described in detail hereafter.

FIG. 4 is an exploded view of the helmet according to an embodiment of the present invention.

As shown in FIG. 4, the helmet according to an embodiment of the present invention includes the head frame 1, the sun visor 100, the glass shield 200, and the chin guard 300.

First rotary coupling portions 110, second rotary coupling portions 210, and third rotary coupling portions 310 are formed at the sun visor 100, the glass shield 200, and the chin guard 300, respectively, and they are coupled to the rotation part 10 (see FIG. 1) at both sides of the head frame 1.

That is, the sun visor 100, the glass shield 200, and the chin guard 300 share the same rotational axis, and the first rotary coupling portions 110, second rotary coupling portions 210, and the third rotary coupling portions 310 can be operated in cooperation with each other.

On the other hand, according to this embodiment, the rotation parts 10 each includes a first rotation-assisting member 400 and a second rotation-assisting member 500, and the rotation-assisting members assist rotation of the sun visor 100, the glass shield 200, and the chin guard 300.

In particular, in this embodiment, the second rotation-assisting members 500 are fixed in seats 5 formed on both sides of the head frame 1 and the first rotation-assisting members 400 are rotated with rotation of the chin guard 300. Chin guard support 7 for supporting the chin guard 300 may be further formed on the head frame 1.

A first bolts 50 and a second bolt 52 for fixing the sun visor 100, the glass shield 200, the chin guard 300, the first rotation-assisting members 400, and the second rotation-assisting members 500 may be disposed in the rotation part 10 through them. The first bolt 50 and the second bolt 52 are disposed through the position of the rotational axis of the components of the rotation part 10 and rotatably fix the components.

FIGS. 5 and 6 are views showing in detail the structure of the rotation part 10 in the helmet according to an embodiment of the present invention.

As shown in FIGS. 5 and 6, the second rotation-assisting member 500, the third rotary coupling portion 310, the first rotation-assisting member 400, the second rotary coupling portion 210, and the first rotary coupling portion 110 are sequentially arranged from the inside in the rotation part 10

In the detailed structure, a first sun visor stopper 112 protruding inward is formed on the first rotary coupling portion 110.

A first hole 212, a glass shield anti-rotational hole 214, a glass shield-rotational projection 216, and a first glass shield stopper 218 are formed at the second rotary coupling portion 210.

A glass shield anti-rotational projection 402, a second hole 404, a glass shield rotation guide 306, and a chin guard anti-rotational projection 408 are formed at the first rotation-assisting member 400.

A through-hole-312 is formed through the third rotary coupling portion 310.

A second glass shield stopper 502, a second sun visor stopper 504, and a chin guard anti-rotational hole 506 are formed at the second rotation-assisting member 500.

The first sun visor stopper 112 protrudes through the first hole 212 and the second hole 404, and the first hole 212 and the second hole 404 are arc-shaped slots, so the first sun visor stopper 112 can move within a predetermined range defined by the first hole 212 and the second hole 404.

The movement range of the first sun visor stopper 112 may be the rotational range of the sun visor 100.

The outer circumference 311 of the third rotary coupling portion 310 is formed to corresponding to the position of the inner circumference of the second hole 404 and the first sub visor stopper 112 is positioned outside the outer circumference 311 of the third rotary coupling portion 310.

The maximum movement range of the first sun visor stopper 112 may be limited by the second sun visor stopper 504 on the second rotation-assisting member 500.

That is, the first sun visor stopper 112 is positioned farthest from the second sun visor stopper 504 when the sun visor 100 has been turned down, and gradually approaches the second sun visor stopper 504 when the sun visor 100 is turned up. Further, when the first sun visor stopper 112 comes in contact with the second sun visor stopper 504, rotation of the sun visor 100 is restricted.

Meanwhile, as described above, the first hole 212 and the second 404 are arc-shaped slots, and in this embodiment, the second hole 404 is longer than the first hole 219.

This is for the first glass shield stopper 218 formed close to an end of the first hole 212 to be inserted and the first glass shield stopper 218 is moved in the second hole 404 within a predetermined range defined by the second hole 404.

The movement range of the first sun visor stopper 112 may

The second glass shield stopper 502 is formed on the second rotation-assisting member 500, so the movement range of the first glass shield stopper 218 can be limited. That is, the first glass shield stopper 218 and the second glass shield stopper 502 limit the rotational range of the entire face frame including the glass shield 200 and the chin guard 300.

In this embodiment, the rotational ranges of the glass shield 200 and the chin guard 300 are made wider than the rotational range of the sub visor 100. Accordingly, when a user opens the face frame, the sun visor 100 is turned with the glass shield 200 and the chin guard 300 in the early stage and is then fixed without turning any more after the first sun visor stopper 112 comes in contact with the second sun visor stopper 504, and thereafter, the glass shield 200 and the chin guard 300 are further turned until the first glass shield stopper 218 and the second glass shield stopper 502 come in contact with each other.

Accordingly, in this embodiment, the sun visor 100 is turned up with the face frame when the opening of the head frame 1 is opened by turning up the face frame, and can be fixed regardless of rotation of the face frame when a predetermined rotational limit is reached, that is, the first sub visor stopper 112 comes in contact with the second sun visor stopper 504.

Meanwhile, the glass shield anti-rotational hole 214 and the glass shield-rotational projection 216 of the second rotary coupling portion 210 and the glass shield anti-rotational projection 402 and the glass shield rotation guide 406 of the first rotation-assisting member 400 are components relating to independent rotation of the glass shield 200.

The glass shield-rotational projection 216 protrudes toward the first rotation-assisting member 400 and is inserted in the glass shield rotation guide 406. The glass shield rotation guide 406 extends to guide the glass shield-rotational projection 216, and particularly in this embodiment, the glass shield rotation guide 406 has prominences and depressions.

Accordingly, the glass shield-rotational projection 216 can be moved step by step over the prominences and depressions of the glass shield rotation guide 406, and accordingly, it is possible to adjust the amount of opening of the glass shield 200 in accordance with the position of the glass shield-rotational projection 216.

The glass shield anti-rotational projection 402 is inserted in the glass shield anti-rotational hole 214 that is an arc-shaped slot, so the glass shield anti-rotational projection 402 can move within a range limited to the range of the glass shield anti-rotational hole 214. That is, the movement range of the glass shield anti-rotational projection 402 may be the rotational range of the glass shield 200.

The chin guard anti-rotational projection 408 of the first rotation-assisting member 400, the through-hole 312 of the third rotary coupling portion 310, and the chin guard anti-rotational hole 506 of the second rotation-assisting member 500 are components relating to independent rotation of the chin guard 300.

The chin guard anti-rotational projection 408 protrudes toward the second rotation-assisting member 500 and is inserted in the chin guard anti-rotational hole 506 through the through-hole 312.

The chin guard anti-rotational hole 506 is an arc-shaped slot and the chin guard anti-rotational projection 408 can move within a range limited to the length of the chin guard anti-rotational hole 506. That is, the movement range of the chin guard anti-rotational projection 408 may be the rotational range of the chin guard 300.

As described above, according to the present invention, independent rotational ranges and cooperative rotational ranges of the components are achieved by close connection among the second rotation-assisting member 500, the rotary coupling portion 310, the first rotation-assisting member 400, the second rotary coupling portion 210, and the first rotary coupling portion 110.

The process of opening the face frame is described again hereafter with reference to FIGS. 7 to 10.

First, as shown in FIG. 7, the second rotation-assisting member 500 is placed and fixed in the seat 5 of the head frame 1. That is, the second rotation-assisting member 500 is fixed without rotating, and the third rotary coupling portion 310, the first rotation-assisting member 400, the second rotary coupling portion 210, and the first rotary coupling portion 110 can be rotated relative to the second rotation-assisting member 500.

When the face frame is closed to cover the opening of the head frame 1, as shown in FIG. 8, the distance between the first sun visor stopper 112 and the second sun visor stopper 504 and the distance between the first glass shield stopper 218 and the second glass shield stopper 502 in the second through-hole 404 are the maximum.

The distance between the first glass shield stopper 218 and the second glass shield stopper 502 is larger than the distance between the first sun visor stopper 112 and the second sun visor stopper 504.

When the face frame is opened in this state, the face frame and the sun visor 100 are turned together in the early stage, and as shown in FIG. 9, the first sun visor stopper 112 and the first glass shield stopper 218 are moved in the second through-hole 404.

Accordingly, the first glass shield stopper 218 and the second glass shield stopper 502 come in contact with each other, and the sun visor 100 is fixed without turning any more at the rotational limit.

Thereafter, as shown in FIG. 10, when the face frame is further turned up, it can move further moved until the first glass shield stopper 218 comes in contact with the second glass shield stopper 502, and the face frame stops turning at the moment that the first glass shield stopper 218 comes in contact with the second glass shield stopper 502.

As described above, when the opening of the head frame is opened by turning up the face frame, the sun visor is turned up with the face frame in the early stage, but the sun visor can be fixed regardless of rotation of the face frame when a predetermined limit is reached.

Embodiments of the present invention were described above and it will be apparent to those skilled in the art that the present invention may be modified in various ways without departing from the scope of the present invention, other than the embodiments described above. Therefore, the embodiments should be construed as examples, not specifying the present invention, and the present invention is not limited thereto and may be modified within the scope of claims or a range equivalent to the scope.

What is claimed is:

1. A helmet for protecting a head of a user having a face, the helmet comprising:

a head frame configured to cover the head, having an opening adapted to be toward the face of the user, and the head frame having at least one outwardly facing side, a rotation part attached to the at least one outwardly facing side, the rotation part having a rotation-part axis of rotation; and a sun visor, a glass shield and a chin guard, each attached to the rotation part and rotatable by the user about the rotation-part axis of rotation selectively closing the opening of the head frame, wherein the glass shield is disposed over the chin guard to ensure a visual field for the user, wherein the chin guard has a third rotary coupling portion coupled to the rotation part, the glass shield has a second rotary coupling portion coupled to the rotation part outside the third rotary coupling portion, and the sun visor has first rotary coupling portion coupled to the rotation part outside the second rotary coupling portion, wherein a first rotation-assisting member is disposed between the second rotary coupling portion and the third rotary coupling portion; and a second rotation-assisting member is disposed between the third rotary coupling portion and the head frame, wherein the first rotary coupling portion has a first sun visor stopper protruding inwardly, and a second sun visor stopper on the second rotation-assisting member abuts the first sun visor stopper when the sun visor reaches a predetermined rotational limit, wherein the second rotary coupling portion has a first hole therethrough that is a slot into which the first sun visor stopper and the second sun visor stopper extend, and the first rotation-assisting member has a second hole that is a slot into which the first sun visor stopper and the second sun visor stopper extend, wherein the second hole is longer than the first hole, the second rotary coupling portion has a first glass-shield stopper extending into the second hole, and the second rotation-assisting member has a second glass-shield stopper that abuts the first glass-shield stopper to limit a rotational range of the glass shield, and wherein when the chin guard and glass shield are rotated upwardly by the user to open the opening of the head frame, the sun visor rotates upwardly therewith until the predetermined rotational limit of the sun visor is reached and upon further upward rotation of the chin guard and glass shield, the sun visor remains at the predetermined rotational limit.

* * * * *